United States Patent [19]

Schwörer

[11] Patent Number: 4,948,088

[45] Date of Patent: Aug. 14, 1990

[54] SHUTTERING APPARATUS

[75] Inventor: Artur Schwörer, Wullenstetten, Fed. Rep. of Germany

[73] Assignee: Peri-Werk Artur Schwoerer GmbH & Co. KG, Weissenhorn, Fed. Rep. of Germany

[21] Appl. No.: 274,545

[22] Filed: Nov. 22, 1988

[30] Foreign Application Priority Data

Nov. 23, 1987 [DE] Fed. Rep. of Germany ..... 3739635

[51] Int. Cl.[5] ..... E04G 9/02

[52] U.S. Cl. ..... 249/196; 249/47; 249/192; 403/108

[58] Field of Search ..... 249/44, 47, 189, 192, 249/193, 196, 210; 403/108, 104

[56] References Cited

U.S. PATENT DOCUMENTS

| | | | |
|---|---|---|---|
| 2,336,253 | 12/1943 | Jennings | 249/196 |
| 2,801,454 | 8/1957 | Troiel | 249/192 |
| 3,399,859 | 9/1968 | Bowden et al. | 249/189 |
| 3,791,615 | 2/1974 | Ewing | 249/196 |

*Primary Examiner*—James C. Housel

*Attorney, Agent, or Firm*—Townsend and Townsend

[57] ABSTRACT

A shuttering apparatus includes at least two rectangular shuttering panels (22, 22') which have a plurality of bores of the same dimensions which extend along at least one edge (13, 15) in a row parallel to the edge and are arranged in accordance with a grid dimension at grid points having the same spacing. The bores have axes extending perpendicular to the edge. The shuttering panels are capable of being placed together with their edges containing the bores (11, 11') being so aligned that several connection bores (11, 11') of the one shuttering panel are aligned with several connection bores (11, 11') of the other shuttering panel. In this way a form locked connection of the shuttering panels (22, 22') in the direction of the edge (13, 15) which contains the lines of bores can be brought about by fitted connection pins which are placed through at least some of the aligned bores (11, 11') of the two shuttering panels (22, 22'). Only some of the mutually associated connection bores (11) are arranged at the grid points (12) at the edges of each shuttering panel. The other connection bores (11') are displaced by less than half the grid point spacing (a) relative to the grid points (12) and indeed in the one shuttering panel (12) in the opposite direction to those of the other shuttering panel (22').

20 Claims, 4 Drawing Sheets

Figure 1:
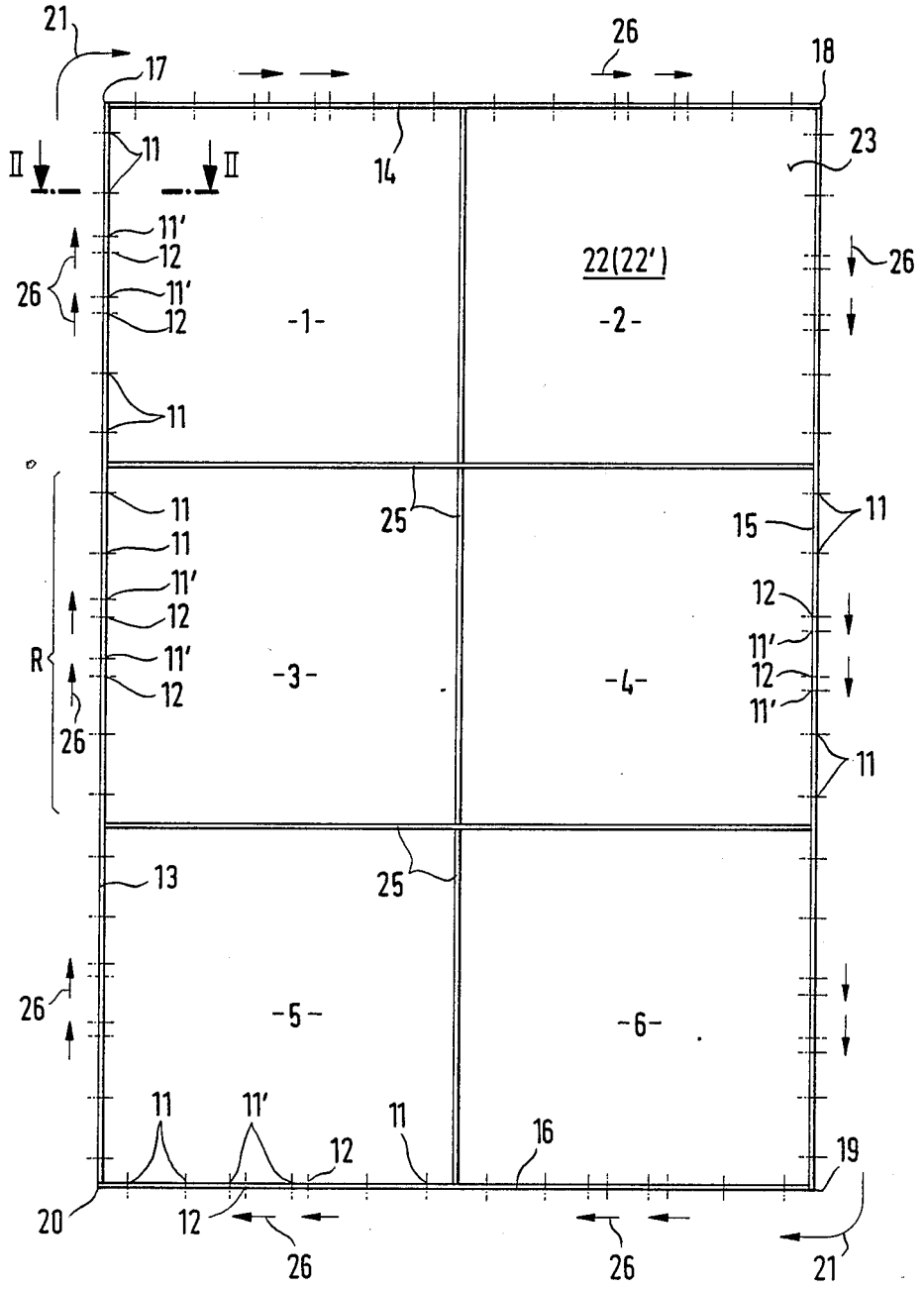

23
22
22'
11
11'
13
15
15'
a/2
a/4
3/4 a

SHUTTERING APPARATUS

The invention relates to a shuttering apparatus comprising at least two shuttering panels having at least one straight edge, preferably rectangular shuttering panels, wherein the panels have a plurality of bores of the same dimensions which extend in a row parallel to the edge and are arranged in accordance with a grid dimension at grid points having the same spacing, and which have axes extending perpendicular to the edge; wherein the shuttering panels are preferably capable of being placed together with the edges containing the bores being so aligned that several connection bores of the one panel are aligned with several connection bores of the other panel; and wherein a form locked connection of the shuttering panels in the direction of the edges having the aligned bores can be brought about by means of fitted connection bolts or elements which are passed through at least some of the aligned bores of the two shuttering panels.

Such shuttering apparatus can for example be used to produce a concrete wall out of liquid or flowable concrete. The shuttering panels which are assembled together into larger units in accordance with the concrete wall to be erected are set up at a predetermined spacing from one another whereupon the liquid concrete is then introduced between the shuttering panels.

On putting shuttering panels together to form large shuttering units, i.e. to create the formwork, the problem frequently exists, that the shuttering panels which are generally rectangular and of the same shape have to be displaced in their plane relative to one another vertically or laterally in order to overcome the particular shuttering problem, for example due to unevenness of the ground or other irregularities of the concrete wall which is to be produced.

In so far as equispaced circular bores are provided in the mutually disposed edges of the shuttering panels it is only possible to realise a displacement of neighbouring shuttering panels by a minimum amount corresponding to the bore spacing.

In order to make smaller displacements of adjacent shuttering panels possible use has already been made of elongate slots as connection bores, this has however the disadvantage that the edges which are connected to one another by bolts are only connected together in force transmitting manner, but not however in form locked manner, so that relative displacements between the individual shuttering panels can arise, for example during crane transport of larger pieces of formwork assembled from several shuttering panels. Thus the danger exists that the previously effected careful adjustment of the shuttering panels relative to each other will be lost.

The object of the present invention is to provide a shuttering apparatus on the initially named kind, the shuttering panels of which can also be connected together while displaced by smaller amounts than the grid point spacing, without having to do away with the desired form locked arrangement of the interconnection of the shuttering panels in the direction of the edge at which the connection takes place and without having to increase the number of the bores.

In order to satisfy this object the invention provides that only some of the mutually associated bores at the edge of each shuttering panel lie at the grid points and others are arranged displaced by half the grid point spacing or preferably less relative to the grid points, and indeed in the one panel in the opposite direction to the other panel; and in that, in particular, both the non-displaced and the displaced bores are respectively distributed over the full length of the edge.

The non-displaced and displaced bores are thus preferably arranged in a mixed fashion along each edge so that for each displacement several connection elements can be mounted distributed along the whole length of the edge.

As a result of this construction specific displacements lying between the grid point spacing can also be realized. This is possible since bores of the contacting edges of the shuttering panels which are to be connected together repeatedly come into alignment with one another at specific displacements within the grid point spacing, so that the connection bolts can be passed through the aligned bores in order to realise a form fitted connection between the two edges at these points. The bolts can be secured by nuts and be clamped against the edges through which the bolts pass. Alternatively threadless bolts can be used which merely ensure the precise form locked alignment of the aligned bores, whereas the forces which are to clamp the two shuttering panels against one another are generated in different manner, for example by clips or the like. Furthermore, a connection element such as is described in DE-OS No. 37 39 633.1 (=USSN 07/274,585 simultaneously submitted patent application of the applicants with the title "Shuttering apparatus, our reference P 3225, now U.S. Pat. No. 4,886,234) is also preferably usable as a connection element.

A preferred embodiment is characterised in that the displacement amounts to $\frac{1}{3}$ to 1/5 and preferably to $\frac{1}{4}$ of the grid point spacing (a). In this preferred embodiment several intermediate values of the displacement between the grid point spacing can be effected.

In the simplest case each second bore can be displaced.

A specially preferred embodiment is characterised in that in each case two non-displaced bores follow one another and in that a displaced bore is disposed between each pair of these non-displaced bores.

The three last named embodiments, and in particular the last one are particularly preferred since substantially smaller displacements than the grid point spacing can be realized.

A yet further alternative embodiment is characterised in that in each case three displaced bores follow three non-displaced bores.

Moreover, all the last four embodiments are preferably contrived, so that at least one grid point at which no bore is present is provided between each group of sequential displaced and non-displaced bores.

This is particularly advantageous since with no displacement and with displacements by the half, a whole, or three half grid point spacings relatively many bores come into alignment. Indeed, with these embodiments, it is possible to reduce the number of bores.

In the simplest case at least two non-displaced bores separated by at least one displaced bore and at least two displaced bores separated by at least one non-displaced bore are provided in each edge. This measure ensures that a specific grid dimension repeats at least twice, which is important in order that at least two bores of the two edges come into alignment in any displaced position over the length of one edge.

Thus, the invention is intended to ensure that at least two shuttering panels are connected together in form locked manner by at least two pins. It is however particularly preferred when the bore arrangement lying in the grid dimension repeats several times so that in each case two adjacent shuttering panels can be connected to one another in form locked manner through a variety of pins.

When bores are provided in two oppositely disposed edges of the shuttering panels the bore arrangement in the one edge preferably extends in the opposite manner to that in the oppositely disposed edge.

When bores are provided in at least three edges of a shuttering panel the bore arrangement of an edge which meets with another edge at a corner is preferably the same starting from this corner as the bore arrangement starting from the other end of the other edge.

If this concept is extended to all four edges of a rectangular shuttering panel then the same bore arrangement repeats itself in a specific peripheral sense along the margins around the shuttering panel.

These embodiments ensure that only shuttering panels with precisely the same bore arrangements in the grid dimension need be prepared in accordance with the present invention. On placing two adjacent shuttering panels together in the displaced bores of the contacting edges are automatically displaced in opposite directions. This is of particular significance for the practical application of the invention.

A preferred layout at the end of each edge is characterised in that the bore arrangement in each edge of a shuttering panel terminates with a non-displaced bore and preferably with two non-displaced bores.

A specially preferred embodiment is characterised in that the spacing of the last respective bore in each edge of a shuttering panel from the associated end face at the relevant end has a spacing equal to one or more grid point spacings. This embodiment is particularly preferred when one or more bores are omitted at individual grid points between the individual groups of displaced and non-displaced bores.

Although the bores in the edges of the shuttering panels could be arranged with their axes perpendicular to the plane of the shuttering panel the use of the invention is particularly preferred for shuttering panels having edges constructed as planar reinforcement strips which extend at the periphery of a rectangular flat shuttering skin perpendicular to its plane away from the surface which comes into contact with the contrete.

With such shuttering panels the edges formed as reinforcement strips at the periphery of the shuttering panels come directly into contact with one another when two shuttering panels are arranged alongside or above one another in alignment with one another.

The shuttering panels may also carry reinforcement strips at the rear side of the shuttering skin which extend between the edges and preferably parallel or perpendicular thereto, with the plane of reinforcement strips being perpendicular to the plane of the shuttering panel.

This embodiment has the advantage that the shuttering skin is not only reinforced by the edges provided with the bores but is also reinforced by the reinforcement strips arranged between the edges.

Each shuttering panel can be subdivided into grid squares, each of which is bounded by reinforcement strips of which one or two can be reinforcement strips forming the edges. With this arrangement each edge portion of a shuttering panel bonding an edge of a grid square is preferably provided with a standard array of displaced and non-displaced bores.

The formation of grid squares in this way has the advantage that both smaller and also larger shuttering boards can be manufactured with bore arrangements which precisely match one another simply by varying the number of grid squares. The grid squares, whose edges are provided with bores in correspondence with the length of the grid dimension terminate, in accordance with the invention, at both ends of each edge provided with bores in a non-displaced bore or in a group of non-displaced bores.

Figure 2:
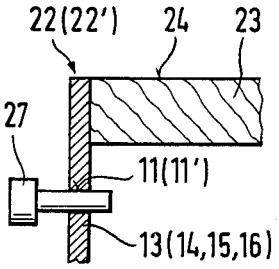
Figure 3:
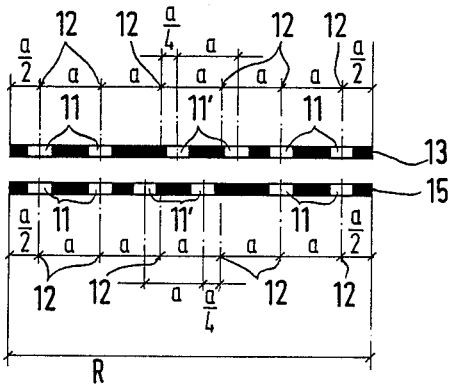
Figures 4A, 4B, 4C, 4D, 4E, 4F, 4G, 4H:
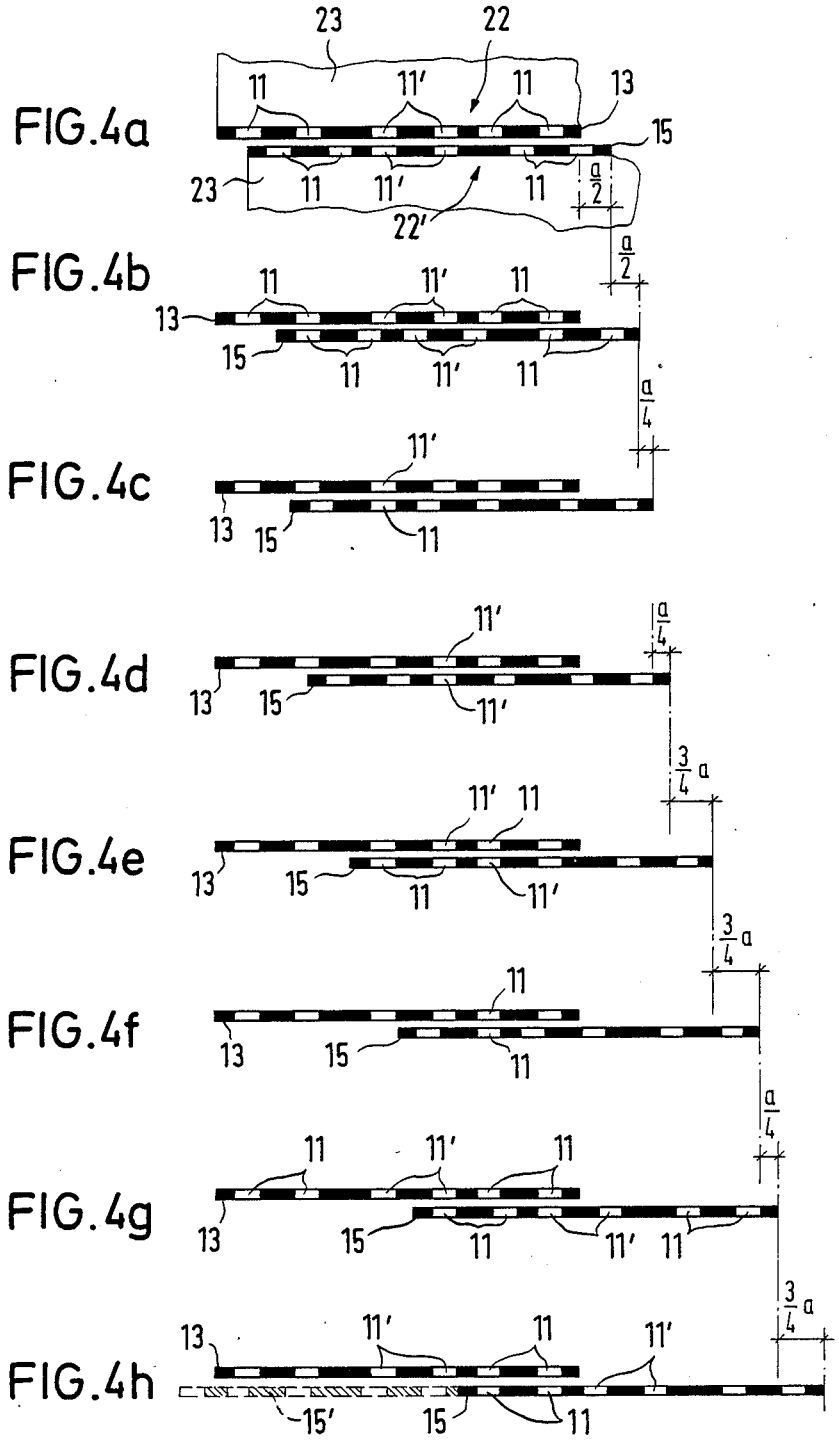
Figure 5:
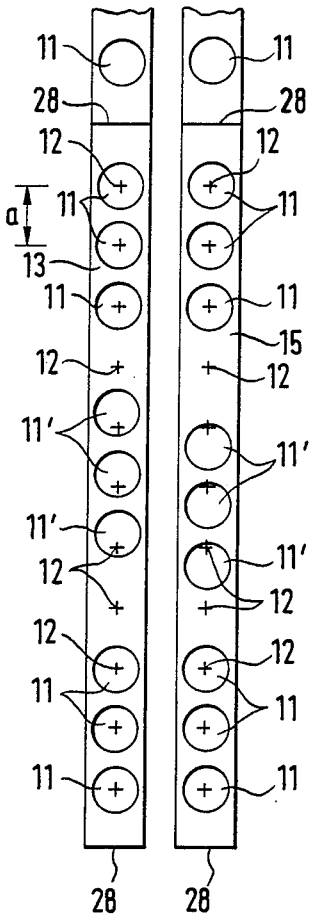

The invention will now be described in the following by way of example and with reference to the drawings in which are shown:

FIG. 1 the rear view of a shuttering panel or a shuttering apparatus in accordance with the invention, FIG. 2 an enlarged section along the line II—II of FIG. 1, FIG. 3 a schematic rear view analogous to FIG. 1 of two oppositely disposed edges of two adjacent shuttering panels as shown in FIGS. 1 and 2, with a bore arrangement in accordance with the invention being shown, FIGS. 4*a* to 4*h* the displacements which are possible between two neighbouring shuttering bores using the bore arrangement of FIG. 3, and FIG. 5 a plan view on the edges of two adjacent shuttering boards with a particularly preferred bore arrangement wherein one bore is in each case omitted between groups of displaced and non-displaced bores.

In accordance with FIGS. 1 and 2 each shuttering board 22 and 22' respectively comprises a flat shuttering skin 23 of rectangular shape which is braced against distortion at its rear side by reinforcement strips 25 of structural steel. Edges 13, 14, 15, 16 which are likewise formed as reinforcement strips are arranged at the periphery of the shuttering skin 22, 22'. These strips are flat in the same way as the reinforcement strips 25 and extend perpendicular to the plane of the shuttering skin 23 rearwardly away from the surface 24 facing the concrete, so that they project rearwardly beyond the shuttering skin 23 in the manner shown in FIG. 2. As seen in the FIGS. 1 to 3 uniformly dimensioned circular bores 11 and 11' are respectively provided in the edges 13, 14, 15, 16 of the shuttering panels 22, 22' and are arranged as shown in FIG. 3 over the grid repetition length R. Pins 27 (FIG. 2) can be inserted with a fitted seat through these bores. The pins are secured in any desired manner (not shown) for example in accordance with the above mentioned Offenlegungsschrift.

As seen in FIG. 3 imaginary grid points 12 are located at uniform grid point spacings a at each edge 13, 14, 15, 16 with the first and the last grid point 12 in each case having a distance a/2 from the respective end of the grid repetition length R.

A total of six bores 11, 11' are present in each grid repetition length R of which the two first and the two last bores 11, 11' each lie at a raster point 12 whereas the two central bores 11' are displaced relative to the associated raster points 12 by a/4, and indeed in opposite directions for the oppositely disposed edges 13, 14 of two neighbouring shuttering panels 22, 22' (FIG. 4*a*) which are to be connected together.

In this manner adjacent shuttering panels 22, 22' which are arranged alongside one another in non-displaced manner in accordance with FIG. 3 can be connected together in form locked manner in the region of the grid repetition length R by a total of four pins which are pushed through the aligned bores 11.

If the two edges 13, 15 are displaced in accordance with FIG. 4*a* relative to one another by a distance a/2 in the direction of the longitudinal extent of the edges then the two bores 11' come into alignment with one another so that a form locked connection by two pins is also possible in this position.

A further displacement by a/2 in accordance with FIG. 4*b* leads to the alignment of two bores 11, so that with this displacement a form locked connection of adjacent edges 13, 15 is also possible with two pins which are not shown but which fit precisely into the bores 11.

A further displacement by a/4 in accordance with FIG. 4*c* leads to a displaced bore 11' in the edge 13 and a non-displaced bore 11 in the edge 15 come into alignment so that a form locked connection is possible in this displaced position with one pin. In order to ensure a stable connection of adjacent edges 13, 15 the grid repetition length R, in accordance with FIG. 3 should be repeated at least twice along the length of an edge in the event that this displacement is desired, so that a connection of adjacent edges with at least two pins is also possible in this displaced position.

A further displacement through a/4 in accordance with FIG. 4*d* leads to the alignment of two displaced bores 11' so that a form locked pin connection is also possible in this displaced position. For this displaced position the grid repetition interval R should also be repeated at least twice.

A further displacement through ¾ a in accordance with FIG. 4*e* leads to alignment in each case of a displaced bore 11' and a non-displaced bore 11 in the contacting edges 13, 15, so that a form locked connection of the edges 13, 15 is possible in this displaced position with two fitted pins.

The further displacement through ¾ a of FIG. 4*f* leads to the alignment of two non-displaced bores 11 so that here a form locked connection is again possible only with one pin.

A further displacement through a/4 in accordance with FIG. 4*g* results in the alignment of in each case one displaced and one non-displaced bore 11, 11' in the two edges 13, 15. In this displaced position a form locked connection of the edges 13, 15 with two pins is again possible.

Finally, a further displacement through ¾ a in accordance with FIG. 4*h* leads to the alignment of two non-displaced end bores 11.

FIG. 4*h* further indicates how the relative bore arrangement would appear if a continuation 15' in accordance with a further grid repetition length R (FIG. 3) were to adjoin the edge 15 to the left. In the corresponding manner the edge 13 could also be extended to the right by a further grid repetition length R.

The FIGS. 4*a* to 4*h* make it clear that the bore arrangement of the invention, which does not lead to a multiplication of the number of bores but simply to a displacement of the bores, makes it possible to realise a plurality of displacements smaller than the grid point spacing a.

In accordance with FIG. 1 each shuttering panel can be subdivided into individual grid squares 1, 2, 3, 4, 5 6, of which each has a side length, the same as the grid repetition length R, with the reinforcement strips 25 at the rear of the shuttering skin 23 forming the borders of these grid squares together with the edges 13, 14, 15, 16. Each part of one of the edges 13, 14, 15, 16 which is associated with one of the grid squares 1, 2, 3, 4, 5, 6 has a bore arrangement corresponding to the grid repetition length R (FIG. 3). Thus, in accordance with the invention, at least two grid squares should be arranged alongside one another or above one another in order to permit the connection of adjacent shuttering panels with at least two pins even with displacements of adjacent shuttering panels such as are for example shown in the FIGS. 4*c* and 4*d*.

The reason for terminating each grid repetition interval R with a half grid point spacing a/2 between the last bore 11 and the end of the grid repetition interval R lies in the fact that when arranging several grid squares 1, 2, 3, 4, 5, 6 alongside one another in accordance with FIG. 1 adjacent bores 11 of two neighbouring grid squares have a spacing in accordance with the grid point spacing a.

The displacement of the bores 11' in accordance with the grid points 12 is shown in FIG. 1 by arrows.

If one moves in the sense of the arrow 21 around the shuttering panel 22 or 22' respectively in the view of FIG. 1 then the bore arrangement repeats continuously in accordance with the grid repetition length of FIG. 3 starting from any corner 17, 18, 19, 20 and this leads to the bore arrangements in oppositely disposed edges 13, 15 or 16 extending in precisely opposite manners. In this way the arrangement of identically constructed shuttering panels 22 and 22' alongside one another or above one another automatically leads to bores 11' displaced in the opposite direction, Thus the displacements in accordance with FIGS. 4*a* and 4*h* can be made available with a unitary type of shuttering panel, in order to realise a plurality of displacements of adjacent shuttering panels of an amount which lies beneath the grid point spacing a without increasing the number of bores, but instead solely as a result of the arrangement of the invention.

A particularly preferred arrangement of bores is shown in FIG. 5. There respective groups of three non-displaced bores 11 arranged at the grid point spacing a and of three displaced bores 11' are arranged after one another in two edges 13, 15 of two shuttering panels which are to be connected together and which are schematically illustrated alongside one another. In accordance with the invention, grid points 12 are located between the individual groups of three at which neither a non-displaced bore nor a displaced bore is present. As a result of this arrangement relatively many non-displaced bores 11 which are in alignment with one another are available in the non-displaced state which is important since the non-displaced arrangement of the shuttering panels represents the normal case. The various desired displacements of a/2, a, or 3/2 a can then be effected to the scale a/2. For larger displacements displacements with the dimension a/4 or ¾ a can also be considered.

The edges 13, 15 of FIG. 5 can also be regarded as the edge of a grid square. If several grid squares are placed along one another, as indicated at the top in FIG. 5, then the bores 11 at the abutment positions of the grid squares should have a spacing of 2 a, in other words, the last non-displaced bores 11 in each grid square have a spacing of a to the end 28 of the grid square.

I claim:

1. A shuttering panel comprising: a planar wall having a rectangular shape;

first, second, third and fourth sidewalls extending around said planar wall;

said shuttering panel being divided into a plurality of grid elements having boundary sides with at least some of said boundary sides forming portions of said sidewalls;

wherein equispaced points are distributed along each said sidewall and wherein an array of bores having a layout and being formed in said sidewall for each boundary side of a grid element coincident with a sidewall, said array comprising first bores disposed at some, but not all of said equispaced points and second bores disposed at positions displaced relative from at least some of said equispaced points not having first bores thereat, all said arrays of bores being of the same layout and arranged in a continuously repeating sequence around said shuttering panel.

2. The shuttering panel in accordance with claim 1 wherein one bore corresponds to substantially each equispaced point.

3. The shuttering panel in accordance with claim 1 connectable to a second shuttering panel in alignment therewith and in any one of a plurality of positions displaced relative thereto, an incremental spacing between each said position and its adjacent position, said incremental spacings being smaller than the spacing between said equispaced points.

4. The shuttering panel in accordance with claim 1 wherein said second bores are displaced from $\frac{1}{3}$ to 1/5 of the spacing between said equispaced points.

5. The shuttering panel in accordance with claim 1 wherein said second bores are displaced $\frac{1}{4}$ of the spacing between said equispaced points.

6. The shuttering panel in accordance with claim 1 wherein at least two second bores are adjacent each other forming a pair of second bores and wherein a first bore is disposed between each pair of second bores.

7. The shuttering panel in accordance with claim 1 wherein a pair of adjacent second bores is disposed adjacent a pair of adjacent first bores.

8. The shuttering panel in accordance with claim 1 wherein three adjacent second bores are disposed adjacent three adjacent first bores.

9. The shuttering panel in accordance with claim 1 wherein at least one bore-free equispaced point is disposed between said first bores and said second bores.

10. The shuttering panel in accordance with claim 1 wherein at least two first bores are separated by at least one second bore and wherein each sidewall includes at least two second bores separated by at least one first bore.

11. The shuttering panel in accordance with claim 1 wherein each sidewall terminates with a second bore.

12. A shuttering panel comprising:

a planar wall having a rectangular shape;

first, second, third and fourth sidewalls extending around said planar wall;

said shuttering panel being divided into a plurality of grid elements having boundary sides with at least some of said boundary sides forming portions of said sidewalls;

wherein equispaced points are distributed along each said sidewall and wherein an array of bores having a layout and being formed in said sidewall for each boundary side of a grid element coincident with a sidewall, said array comprising first bores disposed at respective ones of said equispaced points and second bores disposed at positions displaced relative from said equispaced points wherein at least two first bores are disposed adjacent to each other, all said arrays of bores being of the same layout and arranged in a continuously repeating sequence around said shuttering panel.

13. A shuttering panel having at least one straight edge and a plurality of similarly-dimensioned bores formed in a row parallel to and in the edge, adjacent bores being spaced apart at intervals less than twice the spacing of any adjacent interval, said bores forming a plurality of arrays including:

a first array of adjacent bores having a first spacing between adjacent bores;

a second array disposed adjacent said first array; and wherein a bore of said first array and a bore of said second array comprise adjacent bores having a second spacing different from said first spacing.

14. The shuttering panel in accordance with claim 13 wherein said second array comprises a pair of adjacent bores having said first spacing therebetween.

15. The shuttering panel in accordance with claim 13 further comprising a third array of adjacent bores adjacent said second array, said third array having said first spacing between adjacent bores and wherein a bore of said second array and a bore of said third array comprise adjacent bores having a third spacing therebetween, said third spacing being different from said first spacing.

16. The shuttering panel in accordance with claim 15 wherein said spacings between adjacent arrays repeats such that a fourth array is disposed adjacent said third array wherein the spacing between adjacent bores of adjacent arrays are substantially equal.

17. The shuttering panel in accordance with claim 16 wherein, said arrays substantially repeat with substantially equal spacing between arrays continuously along said edge.

18. The shuttering panel in accordance with claim 13 wherein said first array comprises two bores and wherein said second array is disposed between a pair of first arrays.

19. The shuttering panel in accordance with claim 13 wherein said second array comprises two bores and wherein said second array is disposed between a pair of first arrays.

20. The shuttering panel in accordance with claim 13 wherein said first array comprises three bores and wherein said second array comprises three bores.

* * * * *